US005201634A

United States Patent [19]

Hough

[11] Patent Number: 5,201,634

[45] Date of Patent: Apr. 13, 1993

[54] COOLED AEROFOIL BLADE

[75] Inventor: Geoffrey S. Hough, Littleover, England

[73] Assignee: Rolls-Royce plc, London, England

[21] Appl. No.: 361,845

[22] Filed: Mar. 19, 1982

[30] Foreign Application Priority Data

Apr. 28, 1981 [GB] United Kingdom ..... 8113068

[51] Int. Cl.[5] ..... F01D 5/18

[52] U.S. Cl. ..... 416/96 R; 416/95

[58] Field of Search ..... 415/114, 115, 116, 175, 415/177; 416/95, 96 R, 96 A, 97 R, 97 A

[56] References Cited

U.S. PATENT DOCUMENTS

| | | | |
|---|---|---|---|
| 2,782,000 | 2/1957 | Ledinegg | 416/96 R |
| 3,314,650 | 4/1967 | McCormick | 415/115 |
| 3,515,499 | 6/1970 | Beer et al. | 416/97 A |
| 3,738,771 | 6/1973 | Delarbre et al. | 415/114 |
| 4,190,398 | 2/1980 | Corsmeier et al. | 416/96 A |
| 4,302,153 | 11/1981 | Tubbs | 416/96 R |

FOREIGN PATENT DOCUMENTS 1006125 9/1965 United Kingdom .

*Primary Examiner*—Stephen C. Bentley
*Attorney, Agent, or Firm*—Cushman, Darby & Cushman

[57] ABSTRACT

A rotary aerofoil blade is provided with closed cycle sodium cooling. The blade has a shank portion which contains a chamber which is in turn partially occupied by an air cooled core member. The core member serves to condense sodium vapor from the aerofoil portion of the blade. Gutter members within the chamber capture the condensed sodium as it is cenrifuged towards the aerofoil portion and direct it into a further chamber within the blade shank portion from when it flows into passages adjacent the external surface of the aerofoil portion. The high temperature of the aerofoil portion vaporizes the sodium which is then pumped by vapor pressure gradients back to cooled core member whereupon the cycle is repeated.

1 Claim, 2 Drawing Sheets

COOLED AEROFOIL BLADE

This invention relates to cooled aerofoil blades and in particular to aerofoil blades employing a closed cycle cooling system.

It is well known to provide a rotary aerofoil blade with a closed cycle cooling system. This usually takes the form of a number of passages within the blade which extend between the aerofoil portion of the blade and a heat exchanger in its shank portion. The passages are sealed and contain an appropriate material, such as sodium, which is in its liquid state at heat exchanger temperatures and in its vapour state at aerofoil temperatures. In operation the liquid material in the heat exchanger is centrifugally urged by the rotary motion of the aerofoil blade into the relatively hotter aerofoil portion of the blade where it vapourises. The vapour then returns to the heat exchanger as a result of the vapour pressure gradient within the passages and subsequently condenses within the heat exchanger. The cycle is continuously repeated, thereby transferring heat from the aerofoil portion of the blade to its heat exchanger.

In order that such liquid cooled aerofoil blades function as efficiently as possible it is important that the liquid material within the heat exchanger is in effective heat exchange relationship with a suitable external cooling fluid such as air. Since the space available within and in the vicinity of the shank portions of conventional rotary aerofoil blades is usually limited, this is difficult to achieve.

It is an object of the present invention therefore to provide an aerofoil blade having a closed cycle cooling system with a heat exchanger in which enhanced heat exchange is achieved between the cooling liquid within said closed cycle cooling system and a suitable flow of cooling air.

According to the present invention, a rotary aerofoil blade having a closed cycle cooling system comprises an aerofoil cross-section portion, a root portion for the attachment of said aerofoil blade to the periphery of a rotary disc and a shank portion interconnecting said aerofoil portion and said root portion, said closed cycle cooling system comprising a heat exchanger enclosed within said shank portion and a plurality of lengthwise extending passages interconnecting said heat exchanger and a chamber defined within the tip of said aerofoil portion, at least one of said passages being located in a central region of said aerofoil portion remote from the external surface thereof and the remainder of said passages being located adjacent the external surface of said aerofoil portion, said cooling system partially containing a material which is in a liquid state at the temperatures at which said heat exchanger is adapted to operate and in a vapour state at the temperatures at which said aerofoil portion is adapted to operate, said heat exchanger comprising a chamber defined within said shank portion, the interior of said chamber and said tip chamber being interconnected by said at least one passage located in the central region of said aerofoil portion and being partially occupied by a core member adapted to be cooled by a flow of cooling air, liquid directing means being provided to direct any condensed material within said heat exchanger chamber to the remainder of said passages interconnecting said heat exchanger and said tip chamber, and prevent any such condensed material being centrifugally urged into said at least one passageway in the central region of said aerofoil portion.

Said heat exchanger core member preferably encloses a chamber and includes inlet means adapted to permit said cooling air to flow into said chamber and outlet means adapted to permit said cooling air to flow out of said chamber.

Said root portion of said aerofoil blade is preferably provided with at least one lengthwise extending passage which is adapted to be supplied with cooling air and direct that cooling air to the inlet of said core member, said shank portion being provided with at least one passage interconnecting said cooling air outlet means of said core member with the exterior of said aerofoil blade.

Said chamber within said core member and said chamber cooling air outlet means are preferably interconnected in flow series by a plurality of passages within at least a portion of said core member said passages being located adjacent the external surface of said core member.

Said passages within said at least a portion of said core member are preferably supplied with cooling air by ducts interconnecting the interiors of said passages and the interior of said chamber, said ducts being so positioned that cooling air passing therethrough provides impingement cooling of those portions of the walls of said passages which are adjacent the external surface of said core member.

Said passages within said core member are preferably of generally square or rectangular shape cross-section.

Said liquid directing means preferably comprises a plurality of gutter members and a further chamber defined within said shank portion, said gutter members interconnecting said core member and said further chamber, and so disposed as to capture any of said condensed material within said heat exchanger and direct said captured condensed material to said further chamber, said further chamber being interconnected in turn with said passages adjacent the outer surface of said aerofoil portion so that any condensed material directed into said further chamber by said gutter members subsequently flows into said passages adjacent the outer surface of said aerofoil portion.

Said core member may be constructed from a plurality of laminates bonded together to define the form of said core member.

The invention will now be described by way of example with reference to the accompanying drawings in which.

Figure 1:
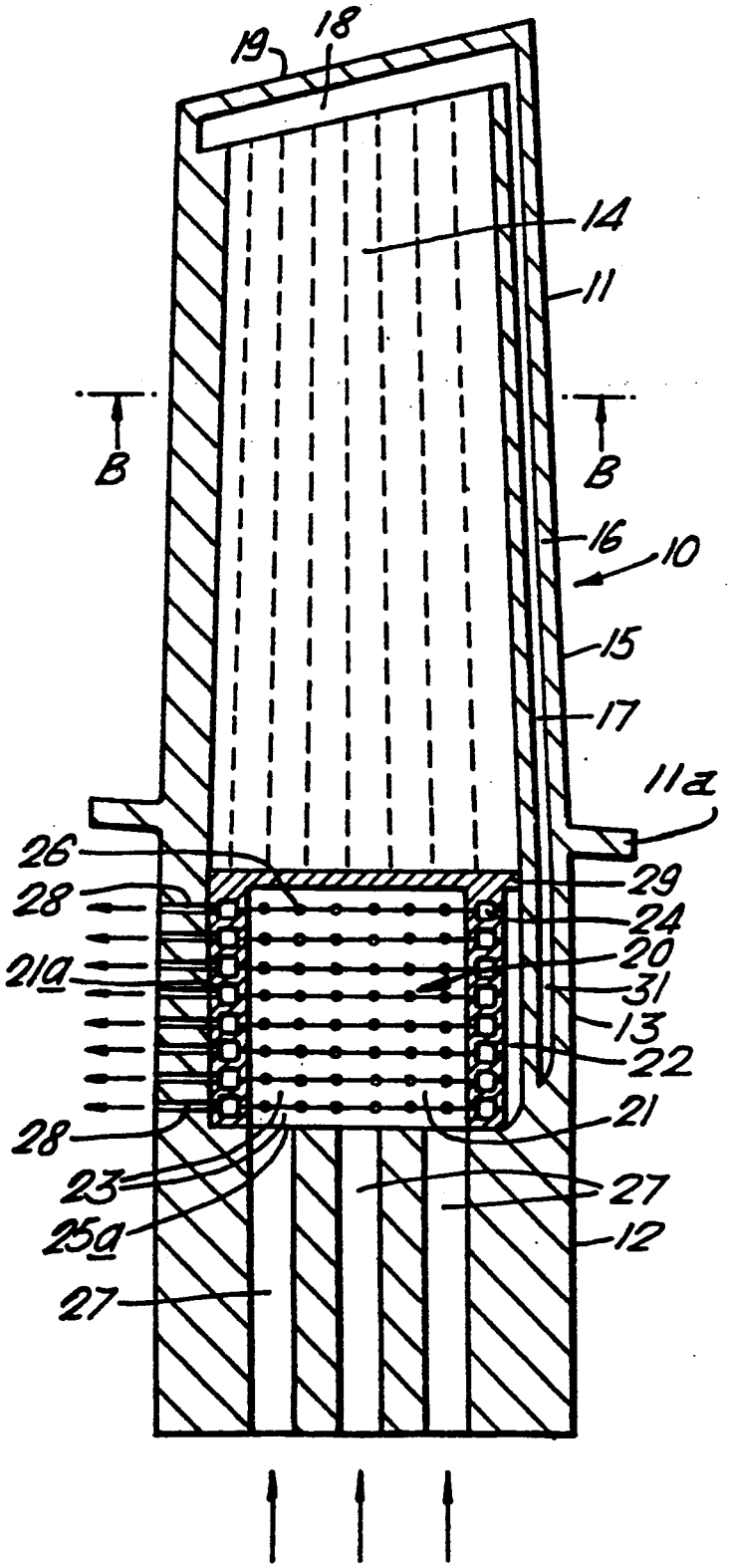
FIG. 1 is a side view on section line A—A of FIG. 2 of an aerofoil blade in accordance with the present invention.

With reference to FIG. 1, a gas turbine engine rotary aerofoil blade (which may be a turbine blade) generally indicated at 10 comprises an aerofoil portion 11 and a root portion 12 which are interconnected by a shank portion 13. A platform 11*a* is provided intermediate the shank and aerofoil portions 13 and 11. The root portion 12 is of the conventional fir tree configuration to facilitate the attachment of the aerofoil blade 10 to the periphery of a rotary disc (not shown).

Figure 2:
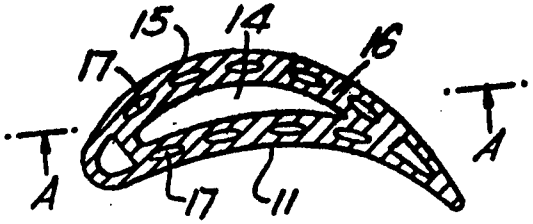
FIG. 2 is a view on section line B—B of FIG. 1.

The aerofoil portion 11 is hollow as can be seen in FIG. 2 so that a lengthwise extending passage 14 which is remote from the external surface of the aerofoil portion 11 is defined within its central region. The aerofoil portion wall 16 is provided with further lengthwise extending passages 17 which are adjacent the external surface 15 of the aerofoil portion 11. All of the passages 14 and 17 are in communication with a chamber 18 which is defined within the tip 19 of the aerofoil portion 11.

Figure 3:
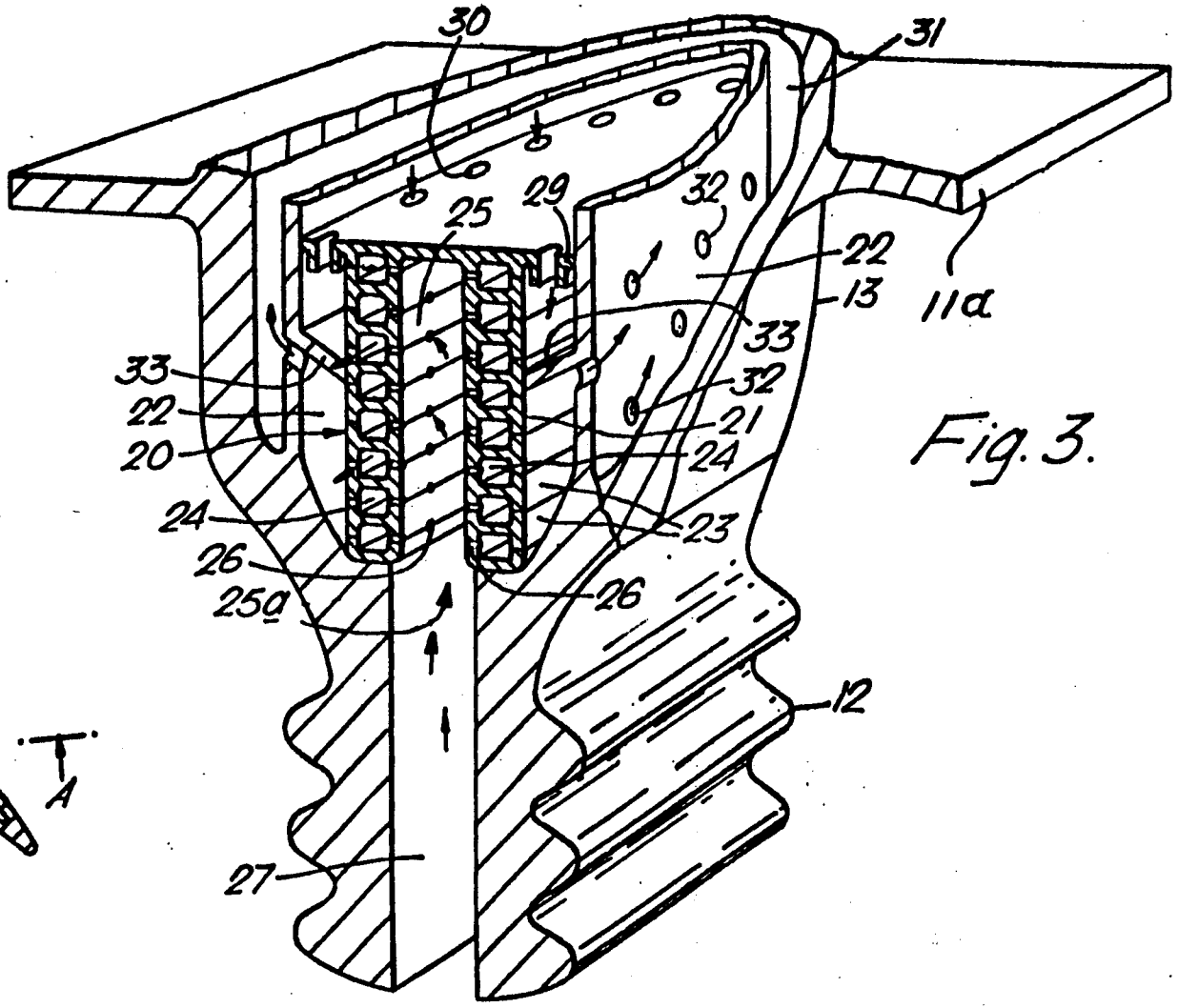
FIG. 3 is a sectioned prespective view of a portion of the aerofoil blade shown in FIG. 1.

The passages 14 and 17 are also in communication with a heat exchanger generally indicated at 20 which is provided within the shank portion 13. The heat exchanger 20 comprises a core member 21 which partially occupies a chamber 22 defined within the shank portion 13. The core member 21, which can be seen more clearly in FIG. 3, is of generally inverted U-shape cross-sectional configuration to define a chamber 25 therein having an open end 25*a* and is made up of a plurality of laminates 23 which are bonded together. Each of the laminates 23 is provided with etched-out portions so that when the laminates 23 are bonded together the etched-out portions define a network of generally square cross-section passages 24. It will be appreciated however that the passages 24 could alternatively be of rectangular cross-sectional shape. The passages 24 are adjacent the majority of the external surface of the core member 21 and are connected to the core chamber 25 by a plurality of ducts 26. The ducts 26 are arranged so as to be generally perpendicular to the passages 24.

The open end 25*a* of the core member 21 constitutes a cooling air inlet which, in operation, is fed with cooling air through three generally lengthwise extending passages 27 provided within the root portion 12. Cooling air is fed to the root portion 12 in the conventional manner through the rotary disc on which it is mounted.

Thus in operation, cooling air flowing through the passages 27 in the root portion 12 passes through the core member air inlet 25*a* and into the chamber 25 defined within the core member 21. It then passes through the ducts 26 to impinge upon the internal walls of the core passages 24 which are adjacent the external surface of the core member 21, thereby providing impingement cooling of those walls. The cooling air then passes through the core passages 24 to provide further cooling of the core member 21 before being exhausted from the core member 21 through outlet ducts 21*a*. The outlet ducts 21*a* are in turn in communication with outlet ducts 28 provided in the shank portion 13 so that the cooling air is eventually exhausted from the aerofoil blade 10. The general flow paths of the cooling air are indicated by arrows in the drawings.

The top of the core member is provided with a flange 29 which forms the upper boundary of the heat exchanger chamber 22. A plurality of apertures 30 in the flange interconnect the heat exchanger chamber 22 with the lengthwise extending passage 14 in the central region of the aerofoil portion 11.

The remaining passages 17 within the aerofoil portion 11 are in communication with a further chamber 31 enclosed within the shank portion 13. The further shank chamber 31 extends around the heat exchanger 20 enclosing the core member 21 and is interconnected with that heat exchanger chamber 22 by a plurality of apertures 32. Each of the apertures 32 is associated with an inverted gutter member 33. The gutter members 33 are downwardly inclined from the apertures 32 to abut the core member 21.

The heat exchanger 20 and the lengthwise extending passages 14 and 17 constitute a closed cycle cooling system which is partially filled with sodium, although it will be appreciated that other suitable cooling materials could be employed. In operation, liquid sodium contained within the lengthwise extending passages 17 adjacent the external surface of the aerofoil portion 11 is centrifugally pumped towards the blade tip 19 by the rotary action of the blade 10. However, as the sodium travels up the passages 17 it is heated by the hot gases which pass in operation over the aerofoil portion 11 and is subsequently vapourised. The sodium vapour travels up the passages 17 and into the tip chamber 18 where it enters the passage 14 in the central region of the aerofoil portion. Vapour pressure gradients result in the vapour being pumped down the passage 14 to the shank portion 13 where it passes through the apertures 30 in core flange 29 and into the heat exchanger chamber 22. Within the heat exchanger chamber 22, the sodium vapour comes into contact with the cooled core member 21 and is thereby cooled and subsequently condensed. The resulting liquid sodium is centrifugally pumped in an upward direction by the rotation of the aerofoil blade until it encounters the gutter members 33. The gutter members 33 capture the liquid sodium and direct it through the apertures 32 into the further shank chamber 31. From the further shank chamber 31, the liquid sodium is centrifugally pumped into the passages 17 whereupon the cycle is repeated.

Thus heat is continuously removed from the aerofoil portion 11 of the aerofoil blade 10 by the sodium and heat is removed in turn from the sodium by the cooling air passing through the heat exchanger member 20. The present invention therefore provides a very compact closed cycle cooled aerofoil blade in which efficient heat exchange occurs between the sodium within the closed cycle system and an externally derived supply of cooling air.

I claim:

1. A closed cycle cooling system in a rotary aerofoil blade having an aerofoil portion, a root portion for the attachment of said aerofoil blade to the periphery of a rotary disc, and a shank portion interconnecting said aerofoil portion and said root portion, said closed cycle cooling system comprising:

a heat exchanger enclosed within said shank portion, a plurality of lengthwise extending passages interconnecting said heat exchanger and a chamber defined within the tip of said aerofoil portion, at least one of said passages being located in a central region of said aerofoil portion remote from the external surface thereof, the remainder of said passages being spaced adjacent to and over a substantial portion of the external surface of said aerofoil portion;

a material partially filling said cooling system, said material being in the liquid state at the temperature at which said heat exchanger operates and in a vapor state at the temperatures at which said aerofoil portion operates, said heat exchanger comprising a chamber defined within said shank portion, the interior of said heat exchanger chamber and said tip portion being interconnected by said at least one passage located in the central region of said aerofoil portion, said shank heat exchanger chamber being partially occupied by a core member having an outer surface and an interior surface, said core member defining an interior chamber and including inlet means to permit a flow of cooling air to said interior chamber along said interior surface of said core member, and outlet means in said core member for permitting said cooling air to flow out of said core member; and liquid directing means for directing any condensed material within said shank heat exchanger chamber to the remainder of said passages interconnecting said heat exchanger and said tip chamber, and for preventing any such condensed material from being centrifugally urged into said at least one passageway in the central region of said aerofoil portion, said liquid directing means including a plurality of gutter members and a further chamber defined within said shank portion, said gutter members interconnecting said core member and said further chamber and being so disposed as to capture condensed material within said heat exchanger and direct said captured condensed material into said further chamber, said further chamber being interconnected in turn with said remainder of said passages adjacent the outer surface of said aerofoil portions so that any condensed material directed into said further chamber by gutter members subsequently flows into said remainder of said passages adjacent the outer surface of said aerofoil portion.

* * * * *